United States Patent [19]

Suwa et al.

[11] Patent Number: 4,744,315

[45] Date of Patent: May 17, 1988

[54] PROCESS FOR BURNING PULVERIZED COAL

[75] Inventors: Toshio Suwa, Kawasaki; Nobuaki Kobayashi; Takashi Hirano, both of Tokyo, all of Japan

[73] Assignee: Nippon Sanso Kabushiki Kaisha, Tokyo, Japan

[21] Appl. No.: 86,146

[22] PCT Filed: Nov. 14, 1986

[86] PCT No.: PCT/JP86/00581

§ 371 Date: Jul. 9, 1987

§ 102(e) Date: Jul. 9, 1987

[87] PCT Pub. No.: WO87/03066

PCT Pub. Date: May 21, 1987

[30] Foreign Application Priority Data

Nov. 15, 1985 [JP] Japan ..... 60-256349
Nov. 15, 1985 [JP] Japan ..... 60-256350

[51] Int. Cl.[4] ..... F23D 1/00
[52] U.S. Cl. ..... 110/347; 431/2
[58] Field of Search ..... 110/341, 347, 260, 261, 110/262; 431/2

[56] References Cited

U.S. PATENT DOCUMENTS 4,089,628 5/1978 Blackburn ..... 110/347 X

FOREIGN PATENT DOCUMENTS 7104006 6/1982 Japan .
0188708 9/1985 Japan .

*Primary Examiner*—Edward G. Favors
*Attorney, Agent, or Firm*—Kane, Dalsimer, Sullivan, Kurucz, Levy, Eisele & Richard

[57] ABSTRACT

There is disclosed a monofuel combustion process for burning pulverized coal. According to this combustion process, pulverized coal having a temperature (t) produces a stable flame having a temperature of not less than 2,000° C. when it is burned with an auxiliary combustion gas having an oxygen content (C). An auxiliary combustion gas is preheated, and then pulverized coal is burned with the preheated auxiliary combustion gas, or, after both an auxiliary combustion gas and pulverized coal are preheated, the gas and the coal are mixed and then burned. In the gas preheating step, the temperature of the auxiliary combustion gas is raised to the temperature T defined by the following formula: $T \geqq \exp\{14.14 - 1.84 \ln C - \exp(0.01127t - 3.444)\}$.

6 Claims, 2 Drawing Sheets

PROCESS FOR BURNING PULVERIZED COAL

TECHNICAL FIELD

This invention relates to a process for burning pulverized coal, the process being suitable, in particular, for burning pulverized coal used as fuel for the melting burner in a metal-melting furnace.

BACKGROUND ART

Burners used in electric furnaces for melting steel scrap or in melting furnaces for copper, require a fuel which has similar properties to that of a liquid fuel such as a heavy oil. These similarities to a liquid fuel include a fuel that generates a flame having a temperature of not less than 2,000° C., and a fuel that produces a stable flame which is not extinguished in spite of an atmospheric temperature of about several hundred Celsius degree.

Although pulverized coal costs less than liquid fuel, it is quite difficult to expect the pulverized coal to have the above-mentioned similar property since its combustion rate is extremely slow. Therefore, as disclosed in Japanese Published Unexamined patent application No. 59-115904, upon the employment of the pulverized coal as fuel for the burner, there has been applied a mixed combustion process in which the pulverized coal is, instead of being burned by itself, burned along with a liquid or gaseous fuel. According to this mixed combustion process, it is possible to produce a flame having a relatively high temperature and also to reduce the fuel cost sO that it is more economical than a monofuel combustion process in which the liquid fuel is burned singly.

However, in the mixed combustion process, there must anyway be used liquid fuel or gaseous fuel. Furthermore, the mixture ratio of the liquid or gaseous fuel, upon the charging of the cold charge (such as steel scrap, aluminum and copper etc.) into the furnace, must be severely increased in order to prevent the flame from extinguishing due to the decrease of the furnace wall-radiated radiant heat in the vicinity of the burner. In other words, the consumption of pulverized coal in accordance with the mixed combustion process is extremely low in contrast to consumption in accordance with the monofuel combustion process, meaning pulverized coal has not been effectively utilized as an economical fuel which can lower energy cost.

The present invention is proposed regarding the above-mentioned situation. An object of the present invention is to provide a process for burning pulverized coal according to which the monofuel combustion of the pulverized coal produces a stable flame having a high temperature of not less than 2,000° C. even though the atmospheric temperature is approximately room temperature.

Another object of the present invention is to provide a process for burning pulverized coal which substantially decreases the fuel expense of burners for melting metals.

DISCLOSURE OF THE INVENTION

In order to attain these objects, the inventor of the present invention perceived that the temperature of the flame produced by the combustion of pulverized coal was related to the temperature of a preheated auxiliary combustion gas, the temperature of the pulverized coal and the oxygen content of the auxiliary combustion gas.

A combustion test was carried out, for pulverized coal having room temperature. In this test, there were prepared several types of auxiliary combustion gases having different oxygen contents. Each of the auxiliary combustion gases was divided into several test gases, and the test gases were then preheated to various temperatures. Pulverized coal was burned with each of the test gases. As the result of this test, it is understood that pulverized coal produces a stable flame having a temperature of not less than 2,000° C. when it is burned with the test gases having temperatures higher than a specific temperature determined by the oxygen content of each test gas. Another combustion test was carried out for pulverized coal preheated to a temperature higher than room temperature. Several types of the test gases were prepared in the same manner as in the test previously mentioned. As the result of this test, it is understood that pulverized coal produces a stable flame having a temperature of not less than 2,000° C. when it is burned with the test gases having temperatures higher than a specific temperature (Even in the instance where the pulverized coal is lower at room temperature) determined by the oxygen content of each test gas. Also, by analyzing both of the above-mentioned results, it is found that pulverized coal produces a flame having a temperature of 2,000° C. when it is burned with an auxiliary combustion gas having the temperature T °C.) defined by the following formula:

$$T=\exp\{14.4-1.84\ln C-\exp(0.01127t-3.444)\}$$

where C is the oxygen content (vol. %) of the auxiliary combustion gas, and t is the temperature (°C.) of the pulverized coal. In other words, pulverized coal having the temperature t produces a flame having a temperature of not less than 2,000° C. when it is burned with a preheated auxiliary combustion gas having the oxygen content C and a temperature over the temperature T that has been defined by the above formula. Accordingly, the present invention provides a process for burning pulverized coal, which includes preheating an auxiliary combustion gas, and burning pulverized coal with the preheated auxiliary combustion gas. In the gas preheating step, the temperature of the auxiliary combustion gas is raised to the temperature T defined by the following formula (i):

$$T\geqq\exp\{14.4-1.84\ln C-\exp(0.01127t-3.444)\} \quad \text{(i)}$$

When the temperature of the auxiliary combustion gas is lower than the value of the right-hand side of formula (i), a stable flame is not generated. Preferably, the oxygen content of the auxiliary combustion gas is not less than 50% by volume. When the oxygen content is less than 50% by volume, the auxiliary combustion gas must be preheated to a severely high temperature in order for the pulverized coal to produce a flame of not less than 2,000° C., which results in an uneconomical preheating process. That is to say, in the process for burning pulverized coal represented by above formula (i), preferably, the oxygen content C of the auxiliary combustion gas is within the limits defined by the following formula (ii):

$$50\text{ vol }\%\leqq C\leqq 100\text{ vol }\% \quad \text{(ii)}$$

The pulverized coal may be preheated before it is burned. By the preheating of the pulverized coal, it is possible to reduce the minimum temperature of the preheated auxiliary combustion gas, the minimum temperature being proper for the production of a flame having a temperature of not less than 2,000° C. It is also possible, by preheating the pulverized coal, to use an auxiliary combustion gas having a relatively low oxygen content. However, it is preferred that the pulverized coal is not preheated to a temperature over 300° C. When the temperature of the pulverized coal exceeds 300° C., a low temperature tar is extracted from the coal, which hinders the pulverized coal from being transferred, for instance, through the transferrence passage of a melting burner. By preheating the pulverized coal, a stable flame can be produced, even though the oxygen content of the auxiliary combustion gas is approximately 30% by volume.

Furthermore, when the temperature of the pulverized coal is not controlled, the pulverized coal may be burned after the preheating of the auxiliary combustion gas to the temperature T defined by the following formula (iii):

$$T \geqq \exp(14.14 - 1.84 \ln C) \quad \text{(iii)}$$

According to this formula (iii), a stable flame can be produced even though the temperature of the pulverized coal is room temperature (i.e., the temperature of the pulverized coal when it is stored in the atmosphere, in other words, a temperature in the range of −50° to +40° C.). However, formula (iii) should be applied only when the oxygen content of the auxiliary combustion gas is not less than 50% by volume since the temperature T of the auxiliary combustion gas according to formula (iii) could be substantially higher than that according to formula (i).

BEST MODE FOR CARRYING OUT THE INVENTION

In order to clarify the operation and effects of the present invention, combustion tests will now be disclosed as follows:

Combustion Test 1

In this test, room temperature denotes the temperature when the pulverized coal is stored in the atmosphere, that is, a temperature of not less than −50° C. and not more than 40° C.

There were prepared five types of auxiliary combustion gases having different oxygen contents, that is, a 100 vol. % pure oxygen and oxygen enriched airs having the oxygen contents of 50 vol. %, 65 vol. %, 80 vol. % and 90 vol. %. Each of the auxiliary combustion gases was divided into four test gases, and by effecting the heat exchange between the test gases and the exhaust gas from an electric furnace, the test gases were preheated to four different temperatures of 300° C., 500° C., 700° C. and 1,000° C. Subsequently, each of these preheated test gases was mixed with pulverized coal of room temperature (including 85 wt. % of coal particles having a particle size of not more than 200 mesh and composed of 15–20 wt. % of volatile matter, 55–65 wt. % of fixed carbon and 10–20 wt. % of ash content) within the nozzle of a melting burner, and next the mixture of the pulverized coal and the corresponding test gas was burned in the atmosphere. During the combustion of the pulverized coal, the temperature of the flame was checked.

Figure 1:
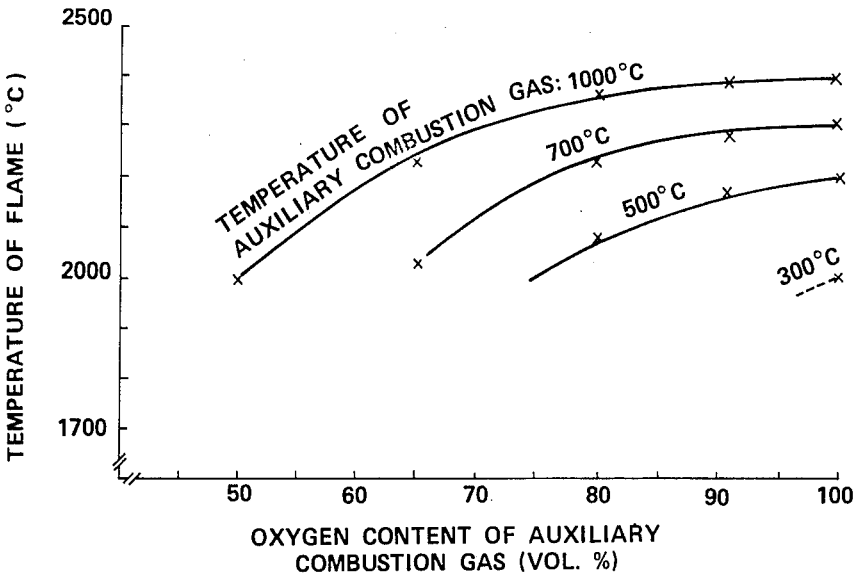
FIG. 1 is a graph showing the relationship between the temperature of flame and the oxygen content and the temperature of the auxiliary combustion gas upon burning pulverized coal of room temperature with the auxiliary combustion gas.
Figure 2:
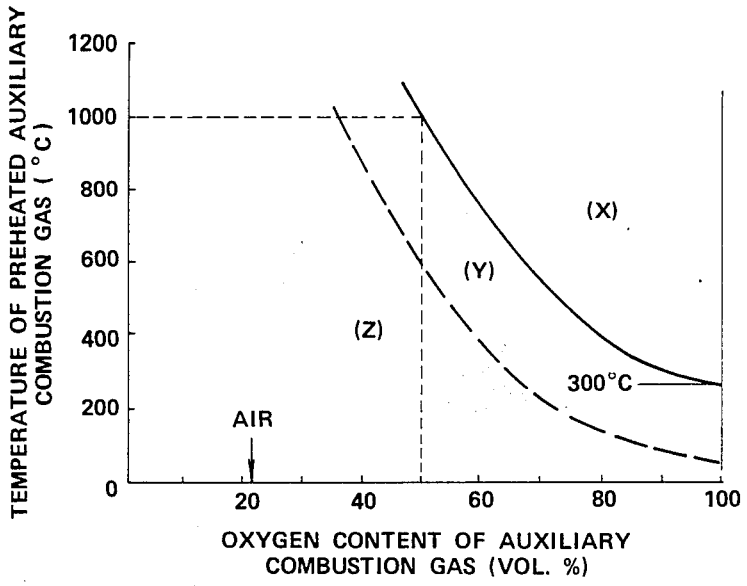
FIG. 2 is a graph showing the relationship between the temperature and oxygen content of the preheated auxiliary combustion gas on condition that the combustion of pulverized coal having room temperature produces a flame havin a temperature of 2,000° C.

The results are plotted in FIG. 1 in which only the data of flames having temperatures of not less than 2,000° C. are shown. From FIG. 1, it will be understood that in order for the combustion of pulverized coal to produce a flame of not less than 2,000° C., it is necessary to preheat the auxiliary combustion gases having the oxygen contents of 100 vol. %, 75 vol. %, 65 vol. % and 50 vol. % respectively to a temperature of not less than 300° C., 500° C., 700° C. and 1,000° C. The curve shown by the solid line in FIG. 2 represents the relationship between the temperature T and oxygen content C of the auxiliary combustion gas on condition that the pulverized coal burned with the auxiliary combustion gas produces a flame having a temperature of 2,000° C. In FIG. 2, the axis of ordinate represents the temperature T and the axis of abscissa represents the oxygen content C. The curve in FIG. 2 is represented by the following approximation:

$$T = \exp(14.14 - 1.84 \ln C)$$

That is to say, pulverized coal of approximately room temperature produces a stable flame which has a temperature of not less than 2,000° C. when it is burned with an auxiliary combustion gas preheated to the temperature T, which satisfies the following condition:

$$T \geqq \exp(14.14 - 1.84 \ln C) \quad \text{(iii)}$$

However, as will be understood from FIG. 2, in the case that an economical preheating of the auxiliary combustion gas is desired, it is preferred to use the auxiliary combustion gas having an oxygen content of not less than 50 vol. % since, when the oxygen content of the auxiliary combustion gas is less than 50 vol. %, the auxiliary combustion gas must be preheated to a temperature of more than 1,000° C. In addition, in FIG. 2, reference letter (X) designates a region in which the pulverized coal produces the stable flame having a temperature of not less than 2,000° C. The broken line designates the approximate boundary partitioning region (Y), in which a stable flame is sometimes produced and sometimes not, from region (Z) in which the stable flame is not produced at all.

Combustion Test 2

There were prepared six types of auxiliary combustion gases having different oxygen contents, that is, a 100 vol. % pure oxygen and oxygen enriched airs having the oxygen contents of 30 vol. %, 50 vol. %, 65 vol. %, 80 vol. % and 90 vol. %. Each of the auxiliary combustion gases was divided into four test gases, and by effecting the heat exchange between the test gases and the exhaust gas from an electric furnace, the test gases were preheated to four different temperatures of 300° C., 500° C., 700° C. and 1,000° C. Pulverized coal (including 85 wt. % of coal particles having a particle size of not more than 200 mesh and composed of 15–30 wt % of volatile matter, 45–60 wt. % of fixed carbon and 10–20 wt. % of ash content) was preheated indirectly by an electric heater, to 260° C. Subsequently, each of the preheated test gases was mixed with the preheated pulverized coal within the nozzle of a melting burner, and next the mixture of the pulverized coal and the corresponding test gas was burned in the atmosphere. During the combustion of each pulverized coal, the temperature of the flame was checked.

Figure 3:
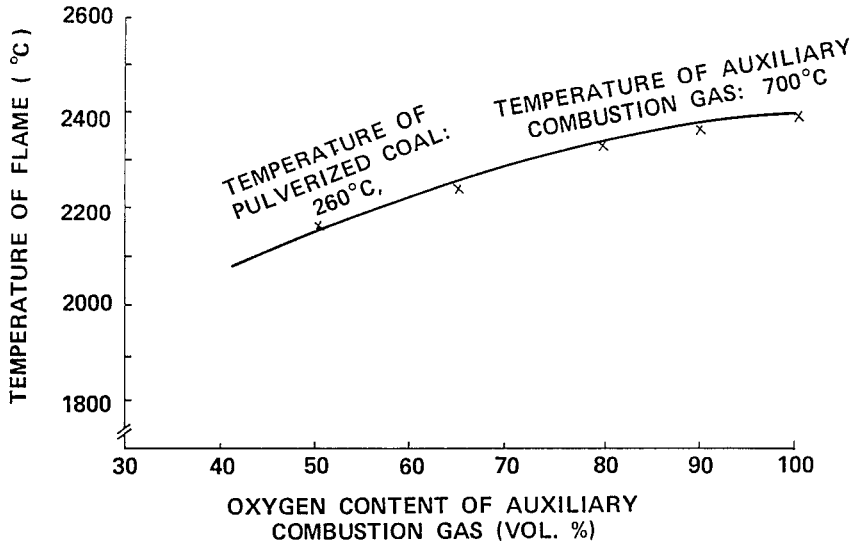
FIG. 3 is a graph showing the relationship between the temperature of flame and the oxygen content of the preheated auxiliary combustion gas upon burning pulverized coal preheated to a temperature of 260° C. in the auxiliary combustion gas preheated to a temperature of 700° C.
Figure 4:
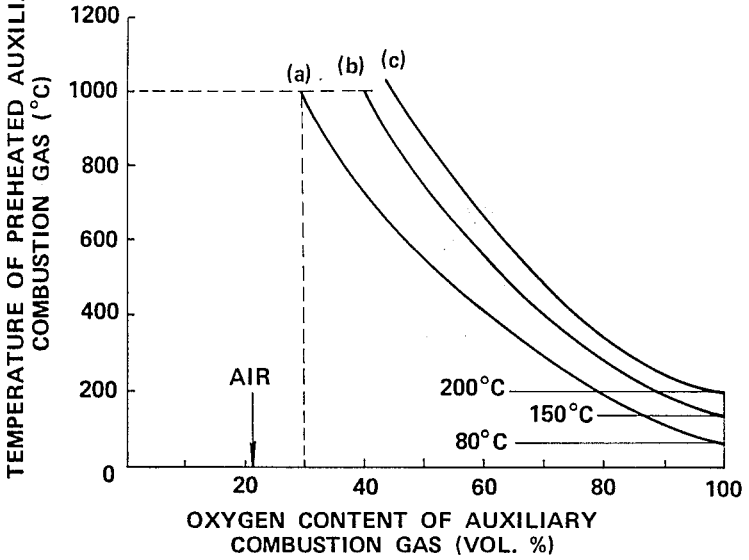
FIG. 4 is a graph showing the relationship between the temperature and oxygen content of the auxiliary combustion gas on condition that the combustions of three types of pulverized coals having temperatures of 260° C., 50° C. and 100° C. produces flames having temperatures of 2,000° C.

The results of the combustion test for the test gas preheated to 700° C. are plotted in FIG. 3, in which the results showing flames having temperatures of less than 2,000° C. are omitted. The curve indicated by reference letter (a) in FIG. 4 represents the relationship between the temperature T and oxygen content C of the auxiliary combustion gas on condition that the pulverized coal burned with the auxiliary combustion gas produces a flame having a temperature of 2,000° C. The curve (a) is represented by the following approximation:

$$T=\exp(13.54-1.84 \ln C)$$

That is to say, pulverized coal having a temperature of 260° C. produces a stable flame having a temperature of not less than 2,000° C. when it is burned with an auxiliary combustion gas preheated to the temperature T, which satisfies the following condition:

$$T \geqq \exp(13.54-1.84 \ln C)$$

Combustion Test 3

In the same manner as the combustion test 2, combustion test was carried out for the pulverized coal which was preheated to 150° C. by an electric heater. The curve indicated by reference letter (b) in FIG. 4 represents the values picked up from the results of the test 3, that is, the relationship between the temperature T and oxygen content C of the auxiliary combustion gas on condition that the pulverized coal burned with the auxiliary combustion gas produces a flame having a temperature of 2,000° C. This curve (b) is represented by the following approximation:

$$T=\exp(13.97-1.84 \ln C)$$

That is to say, pulverized coal having a temperature of 150° C. produces a stable flame having a temperature of not less than 2,000° C. when it is burned with an auxiliary combustion gas preheated to the temperature T which satisfies the following condition:

$$T \geqq \exp(13.97-1.84 \ln C)$$

Combustion Test 4

In the same manner as the combustion test 2, combustion test was carried out for the pulverized coal which was preheated to 100° C. by an electric heater. In the same manner as the other combustion tests 1–3, the curve indicated by reference letter (c) in FIG. 4 represents the values picked up from the results of the test 4. This curve (c) is represented by the following approximation:

$$T=\exp(14.04-1.84 \ln C)$$

That is to say, pulverized coal having a temperature of 100° C. produces a stable flame having a temperature of not less than 2,000° C. when it is burned with an auxiliary combustion gas preheated to the temperature T which satisfies the following condition:

$$T \geqq \exp(14.04-1.84 \ln C)$$

The following is a general expression established by introducing the temperature t of the pulverized coal, as a variable, into the approximations disclosed in the combustion tests 2–4.

$$T=\exp\{14.14-1.84 \ln C-\exp(0.01127t-3.444)\}$$

That is to say, pulverized coal having the temperature t produces a stable flame having a temperature of not less than 2,000° C. when it is burned with an auxiliary combustion gas preheated to the temperature T, which satisfies the following condition:

$$T \geqq \exp\{14.14-1.84 \ln C-\exp(0.01127t-3.444)\} \quad \text{(i)}$$

However, as will be understood from the curve (a) in FIG. 4, it is preferred to use auxiliary combustion gas having an oxygen content of not less than 30 vol. % since, when the oxygen content of the auxiliary combustion gas is less than 30 vol. %, the auxiliary combustion gas must be preheated to a temperature of more than 1,000° C. even though the temperature of the pulverized coal is 260° C.

As has been explained, according to the present invention, the monofuel combustion of pulverized coal produces a stable flame having a high temperature even though the atmospheric temperature is approximately room temperature. Therefore, the fuel expense of a burner for melting metals can be substantially decreased by effectively using pulverized coal which is extremely economical in comparison with liquid fuels. Also, the burner for burning the fuel can be reduced in size since monofuel combustion of the pulverized coal is possible. That is to say, although a mixing section for mixing pulverized coal with liquid fuel (or gaseous fuel) and auxiliary equipments for liquid or gaseous fuel are required in conventional combination burners, no such arrangements are necessary according to the present invention.

INDUSTRIAL APPLICABILITY

The process for burning pulverized coal according to the present invention is extremely effective when it is applied to a combustion of pulverized coal in which the pulverized coal is used as fuel for a melting burner used in an electric furnace for melting steel scrap, in a fusion furnace for melting coppe and the like.

What is claimed is:

1. A process for burning pulverized coal, which comprises steps of preheating an auxiliary combustion gas, and burning pulverized coal with the preheated auxiliary combustion gas, the gas preheating step including the step of:

raising the temperature of the auxiliary combustion gas to the temperature T (°C.) defined by the following formula (i):

$$T \geqq \exp\{14.14 - 1.84 \ln C - \exp(0.01127t - 3.444)\} \quad \text{(i)}$$

where C is the oxygen content (vol. %) of the auxiliary combustion gas, and t is the temperature (°C.) of the pulverized coal.

2. A process for burning pulverized coal as recited in claim 1, wherein the oxygen content C of the auxiliary combustion gas is defined by the following formula (ii):

$$50 \text{ vol. } \% \geqq C \geqq 100 \text{ vol. } \% \quad \text{(ii).}$$

3. A process for burning pulverized coal as recited in claim 2, wherein the temperature T to which the temperature of the auxiliary combustion gas is raised, is defined by the following formula (iii):

$$T \geqq \exp(14.14 - 1.84 \ln C) \quad \text{(iii).}$$

4. A process for burning pulverized coal as recited in claim 3, before the burning step, further comprising the step of: mixing the pulverized coal with the preheated auxiliary combustion gas.

5. A process for burning pulverized coal as recited in claim 1, before the burning step, further comprising the step of: preheating the pulverized coal to the temperature t defined by the following formula (iv):

$$-50° \text{ C.} \leqq t \leqq 300° \text{ C.} \quad \text{(iv)}$$

and wherein the oxygen content C of the auxiliary combustion gas is defined by the following formula (v):

$$30 \text{ vol. } \% \leqq C \leqq 100 \text{ vol. } \% \quad \text{(v).}$$

6. A process for burning pulverized coal as recited in claim 5, before the burning step, further comprising the step of: mixing the preheated pulverized coal with the preheated auxiliary combustion gas.

* * * * *